US008950024B1

(12) United States Patent
Hudson

(10) Patent No.: US 8,950,024 B1
(45) Date of Patent: Feb. 10, 2015

(54) COVERING

(71) Applicant: Ruth Hudson, Vestavia Hills, AL (US)

(72) Inventor: Ruth Hudson, Vestavia Hills, AL (US)

( * ) Notice: Subject to any disclaimer, the term of this patent is extended or adjusted under 35 U.S.C. 154(b) by 0 days.

(21) Appl. No.: 13/754,509

(22) Filed: Jan. 30, 2013

Related U.S. Application Data

(60) Provisional application No. 61/592,229, filed on Jan. 30, 2012.

(51) Int. Cl.
*A47G 9/02* (2006.01)

(52) U.S. Cl.
CPC ..... *A47G 9/0246* (2013.01); *A47G 9/0238* (2013.01)
USPC ..... 5/497; 5/485; 5/494; 5/500; 5/502

(58) Field of Classification Search
CPC ..... A47G 9/02; A47G 9/0238; A47G 9/0246
USPC ..... 5/482, 485, 488, 494–500, 502
See application file for complete search history.

(56) References Cited

U.S. PATENT DOCUMENTS

| | | | | | |
|---|---|---|---|---|---|
| 2,498,055 | A | | 2/1950 | Veit | |
| 3,832,743 | A | | 9/1974 | Smith | |
| 3,857,124 | A | * | 12/1974 | Hadley | 5/496 |
| 3,962,739 | A | * | 6/1976 | Crockett | 5/497 |
| 4,035,854 | A | | 7/1977 | Pardee | |
| 4,045,832 | A | * | 9/1977 | DiForti et al. | 5/496 |
| 4,266,308 | A | * | 5/1981 | Shatz | 5/494 |
| 4,802,250 | A | * | 2/1989 | Farr | 5/482 |
| 4,964,184 | A | * | 10/1990 | Lewis | 5/496 |
| 5,027,460 | A | * | 7/1991 | Honig | 5/497 |
| 5,084,929 | A | | 2/1992 | Staudinger | |
| 5,099,531 | A | * | 3/1992 | Schmier | 5/692 |
| 5,666,680 | A | | 9/1997 | Hackett, Jr. | |
| 5,732,424 | A | | 3/1998 | Bond | |
| 5,901,389 | A | * | 5/1999 | Manner | 5/497 |
| 6,049,925 | A | * | 4/2000 | Lewis | 5/497 |
| 6,061,851 | A | * | 5/2000 | Crowell | 5/497 |
| 6,108,836 | A | * | 8/2000 | Keene, III | 5/497 |
| 7,086,102 | B1 | * | 8/2006 | Frazier | 5/502 |
| 7,231,679 | B2 | * | 6/2007 | Ho | 5/497 |
| 7,290,301 | B2 | | 11/2007 | Ho | |
| 7,487,561 | B2 | * | 2/2009 | Ho | 5/497 |
| 7,810,184 | B2 | | 10/2010 | McCollum | |
| 8,214,949 | B2 | * | 7/2012 | Thompson | 5/494 |
| 2008/0178386 | A1 | * | 7/2008 | Thompson | 5/485 |

* cited by examiner

*Primary Examiner* — Nicholas Polito
(74) *Attorney, Agent, or Firm* — Thomas G. Peterson; Bradley Arant Boult Cummings LLP

(57) ABSTRACT

An improved covering is described for use with a mattress. The improved covering comprises a top sheet securely or removably secured to a bottom sheet. Through the use of the improved covering, the time required for attending to the task of making a bed is reduced and the difficulty of such task is decreased. In addition, using the improved covering of the present disclosure, individuals such as, but not limited to children and those with difficulty attending to such a task, may now complete the task with an aesthetically pleasing result.

7 Claims, 4 Drawing Sheets

COVERING

FIELD OF THE DISCLOSURE

The present disclosure relates generally to an improved covering. The present disclosure relates more specifically to an improved bed sheet.

BACKGROUND

Attending to household tasks is an issue confronted by most individuals on a daily basis. Such tasks include cleaning house, washing clothes, taking out the trash and making beds. The time associated with completing these tasks prevents individuals from attending to more important matters. In addition, for some individuals such as children and the elderly, completion of such tasks can be problematic.

Therefore, any reduction in the time required to complete such household tasks and any way to make such tasks easier to complete would be a benefit. The present disclosure provides a solution to one such common household task—the making of beds. The present disclosure provides an improved covering for beds that reduces the time required to make a bed and renders such tasks easier for an individual to accomplish. Furthermore, the use of the improved covering disclosed herein allows children and other individuals to efficiently take responsibility for such tasks. Therefore, the improved coverings of the present disclosure address a need in the art.

DETAILED DESCRIPTION

Figure 1:
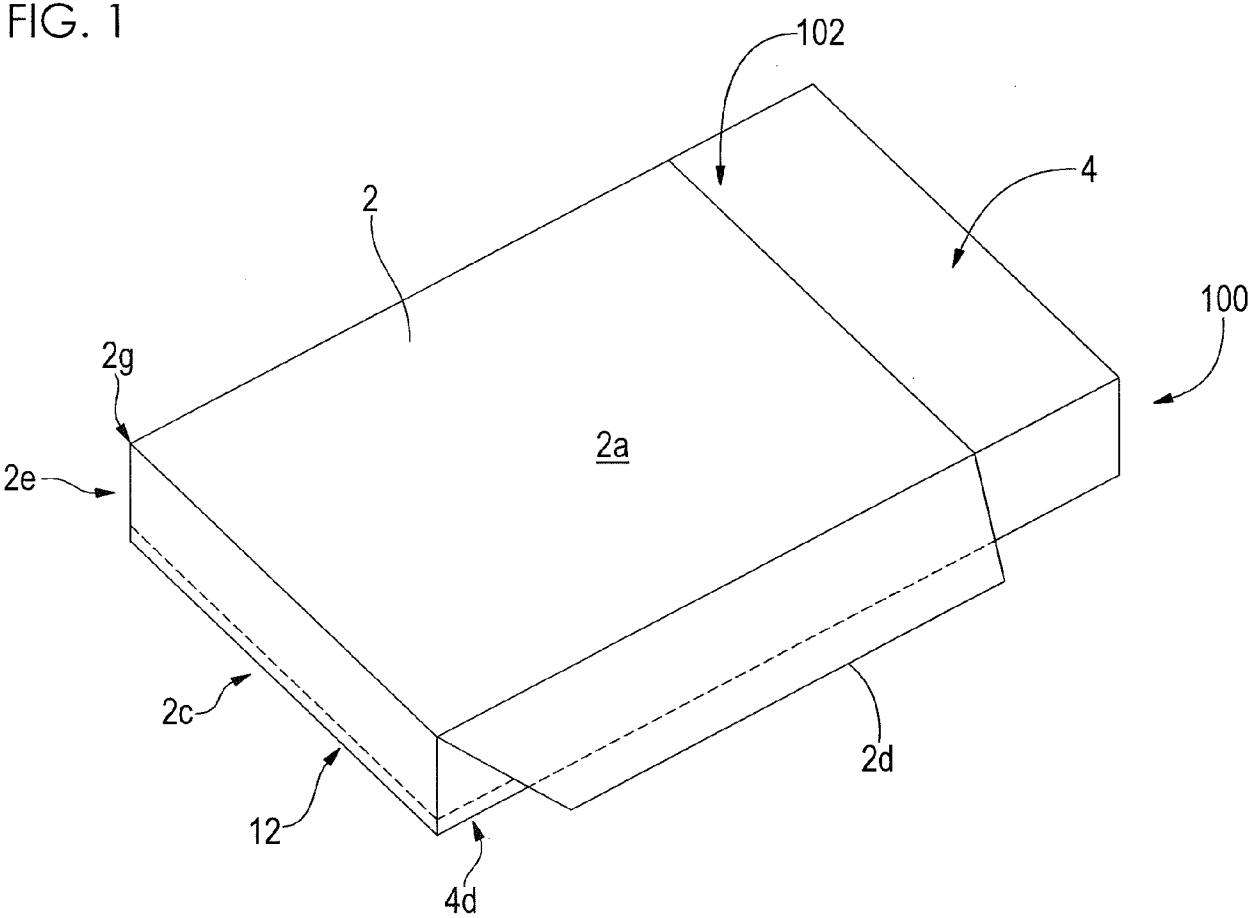
FIG. 1 is a perspective view showing one embodiment of the improved covering of the present disclosure, illustrating securing element 10 as stitching along edges 2*c*/4*c*.

The present disclosure describes improved covering for use with a mattress. The use of the improved covering of the present disclosure provides a number of advantages over the devices of the prior art. Through the use of the improved covering, the time required for attending to the task of making a bed is reduced and the difficulty of such task is decreased. In addition, using the improved covering of the present disclosure, individuals such as, but not limited to children and those with difficulty attending to such a task, may now complete the task efficiently with an aesthetically pleasing result. Furthermore, the improved covering makes cleaning and storage of bed sheets easier. Finally, the improved covering of the present disclosure prevents sheets from becoming un-tucked during the night while providing ample room for the body of a sleeper.

In one embodiment, the improved covering comprises a top sheet 2 and a bottom sheet 4 and a securing element securing at least a portion of the top sheet 2 to the bottom sheet 4. The improved covering is used to attractively and efficiently cover a mattress 100. The mattress 100 has a top surface 102, two sides 104 and a top 106 and bottom 108 end. The dimensions of the mattress 100 are not important to the present disclosure. The improved covering may be adapted to any size or shape of mattress. The top 2 and bottom 4 sheets each have an outer (2*a* and 4*a*, respectively) and an inner (2*b* and 4*b*, respectively) surface as well as 4 edges 2*c*-2*f* and 4*c*-4*f*. As shown in the Figures, edges 2*c* and 4*c* may be seen as corresponding to the bottom or foot end of the sheets (also referred to herein as a bottom edge), edges 2*f* and 4*f* may be seen as corresponding to the top or head of the sheets (also referred to herein as a top edge) and edges 2*d*, 2*e*, 4*d* and 4*e* may be seen as corresponding to the side edges of the sheets (also referred to herein as side edges).

The bottom sheet 4 is configured to snugly cover the mattress 100. In one embodiment, the bottom sheet 4 may be a fitted sheet. By fitted sheet, it is meant a sheet with elastic or other like element secured to the bottom portions of the sheet so that the bottom sheet is securely around a mattress. Such fitted sheets are known in the art. The top sheet 2 is configured to cover, at least partially, the bottom sheet 4. In one embodiment, the top sheet 2 is of such a length and width as to match the length and width of the bottom sheet 4 when the top sheet 2 is secured to the bottom sheet 4.

Figure 2:
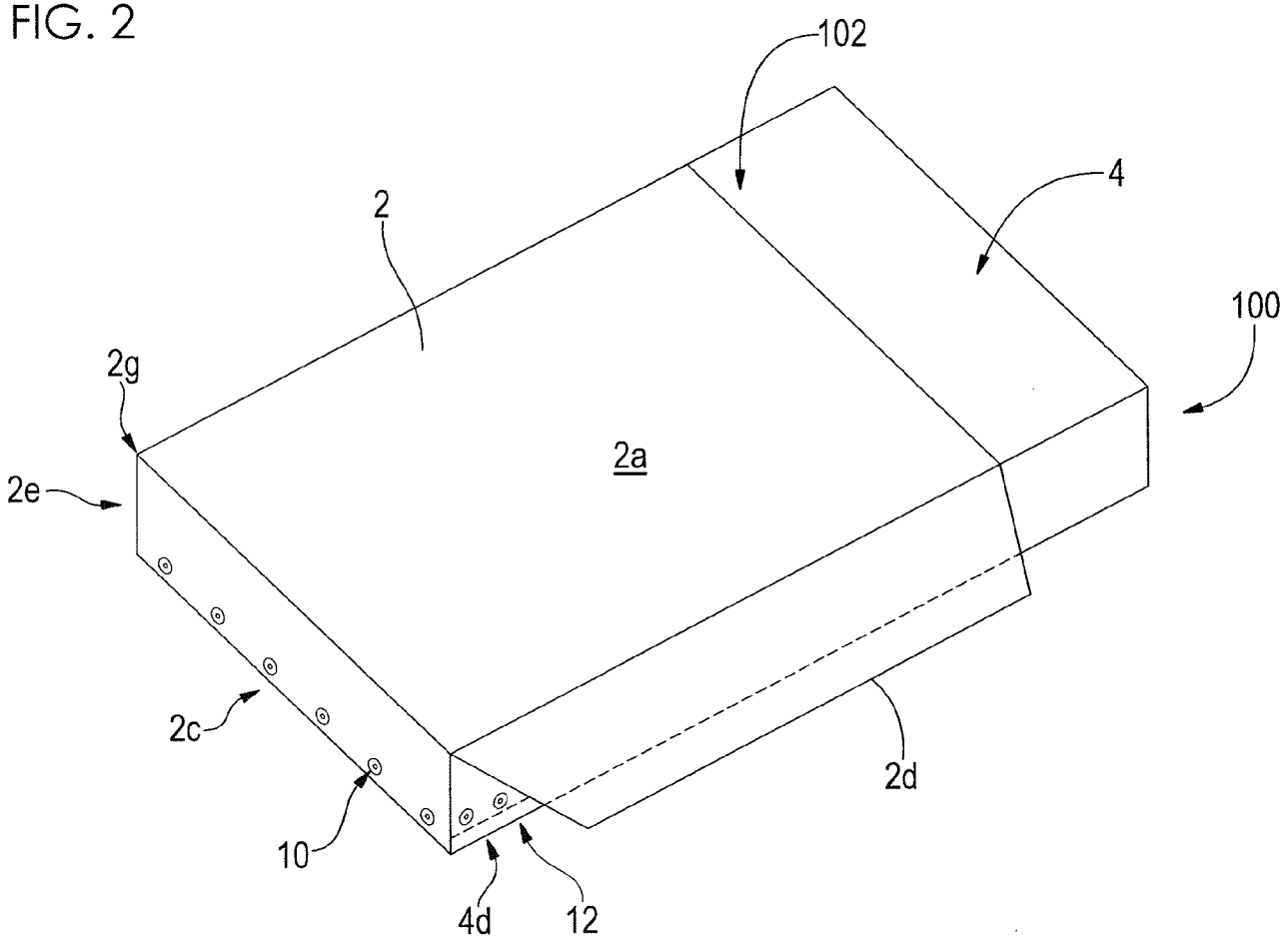
FIG. 2 is a perspective view showing an additional embodiment of the improved covering of the present disclosure, illustrating securing element 10 as buttons along edges 2*c*/4*c*.
Figure 3:
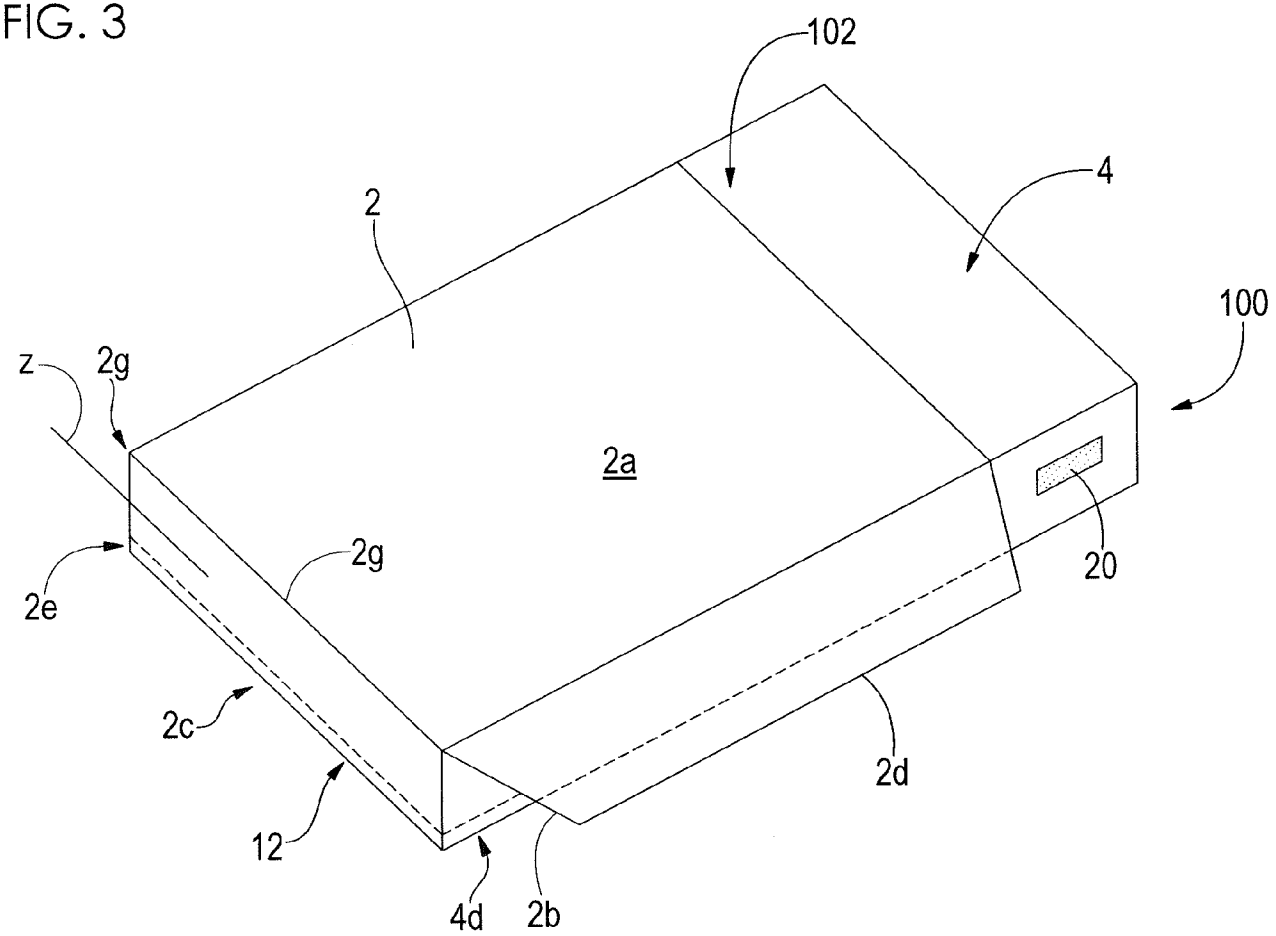
FIG. 3 is a perspective view showing an additional embodiment of the improved covering of the present disclosure, illustrating securing element 10 as stitching along line Z along with pocket 20.
Figure 4A:
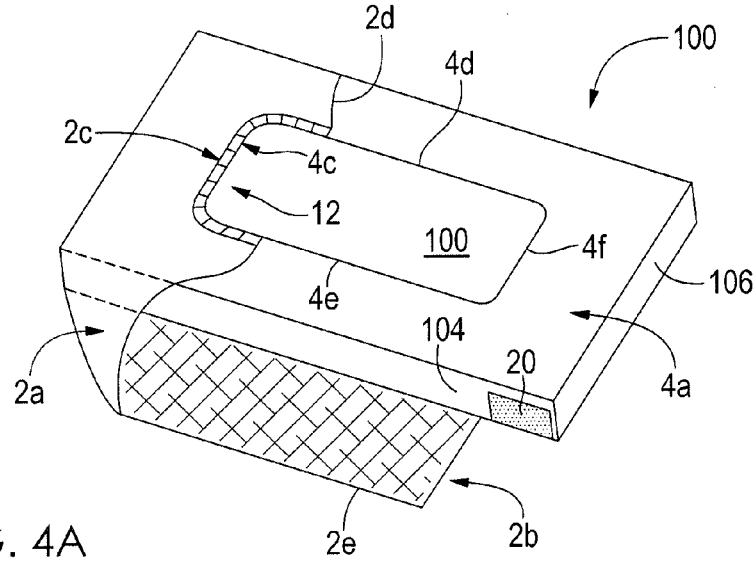
FIG. 4A is a perspective view illustrating the improved covering of the present disclosure as viewed from underneath a mattress illustrating securing element 10 as stitching along edges 2*c*/4*c*.
Figure 4B:
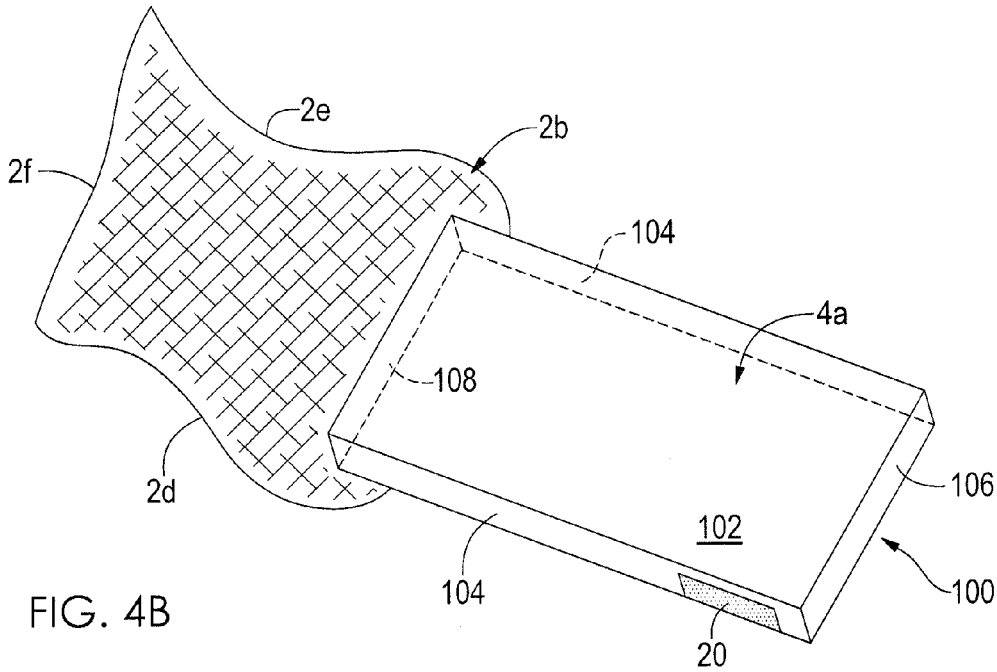
FIG. 4B is a perspective view illustrating the improved covering of the present disclosure as viewed from the top of a mattress.

The top sheet 2 is connected to the bottom sheet 4 by securing element 10. In one embodiment, the top sheet 2 is securely connected to the bottom sheet 4. In another embodiment, the top sheet 2 is reversibly connected to the bottom sheet 4. The securing element 10 may be positioned in a number of ways to secure the top 2 and bottom 4 sheets together. In one embodiment, securing element 10 is positioned so that it is visible to an observer viewing the improved covering when it is placed on a mattress 100 (see for example FIGS. 1-3). In another embodiment, securing element 10 is positioned so that it is not visible to an observer viewing the improved covering when it is placed on a mattress 100 (see for example, FIGS. 4A and B). In still a further embodiment, one portion of the securing element may be visible to an observer and one portion of the securing element may be invisible to an observer.

In one embodiment, securing element 10 is positioned along at least a portion of the length of edges 2*c* and 4*c* (the bottom edges). In a particular embodiment, the securing element 10 may be positioned along substantially the entire length of edges 2*c* and 4*c*. By the term substantially, it is meant at least 90% of the length of the recited edges, at least 95% of the length of the recited edges or 100% of the length of the recited edges.

In another embodiment, securing element 10 is positioned along at least a portion of the edge 2*c* and 4*c* (the bottom edges) and along at least a portion of the edges 4*d* and 4*e* (the side edges). In a further embodiment, the securing element 10 may be positioned along substantially the entire length of edges 2*c* and 4*c* and along at least a portion of the edges 4*d* and 4*e*. In these embodiments, the bottom edge 2*c* of the top sheet 2 is secured to the side edges 4*d* and 4*e* of the bottom sheet 4. In one embodiment, the stitching extends from 2-12 inches along the sides edges 4*d* and 4*e*. In another embodiment, the stitching extends from 4-8 inches along the sides edges 4*d* and 4*e*. In such an embodiment, the natural tendency of the top sheet is to form an aesthetically pleasing corner when the improved covering is placed on the mattress.

In still a further embodiment, securing element 10 is positioned along at least a portion of line Z. Line Z may be positioned at any point between edge 2*c*/4*c* and edge 2*g* (the point where the top sheet 2 transitions from the bottom end 108 and the top surface 102 of the mattress 100. In a particular embodiment, line Z is midway between edge 2*c*/4*c* and edge 2*g*. In a particular embodiment, the securing element 10 may be positioned along the entire line Z.

In still a further embodiment, securing element 10 is positioned so that it is not visible to an observer viewing the improved covering when it is placed on a mattress 100. In this embodiment, securing element 10 may be placed on a portion of the bottom sheet 4 that is tucked under the mattress 100 or otherwise hidden from view by the mattress 100. In yet another embodiment, a portion of securing element 10 is positioned so that it is not visible to an observer viewing the improved covering when it is placed on a mattress 100 and a portion of securing element 10 is visible to an observer viewing the improved covering when it is placed on a mattress 100.

In any of the foregoing embodiment, the securing element may be placed along the entirety of at least one of edge 2*d*/4*d* and 2*e*/4*e*. Such an embodiment is useful when the mattress is positioned close to a wall or other object that limits access to the mattress adjacent to edge 2*d*/4*d* and/or 2*e*/4*e*. Furthermore, in any of the foregoing embodiment, the securing element 10 may be independently selected from those elements described herein for placement along the various edges and lines.

In any of the foregoing embodiment, the improved covering may be removably or securely secured to the mattress 100. The nature of the placement of the securing element provides an aesthetically pleasing appearance to the finished bed.

The securing element 10 may be any securing element known in the art. In one embodiment, the securing element 10 is stitching 12 as illustrated in the figures. However, the nature of the securing element should not be so limited. In alternate embodiments the securing element 10 is a button assembly comprising a button on one of the top 2 or bottom 4 sheets and a slit to securely receive the button on the other of the top 2 or bottom 4 sheets. In this embodiment, the securing element may also be a decorative element as well and may be selected based on the color of the top 2 and/or bottom 4 sheets. In a further embodiment, the securing sheets and a female snap element on the other of the top 2 or bottom 4 sheets. In still a further embodiment, the securing element 10 is a hook and loop assembly, such as Velcro, comprising a hook assembly on one of the top 2 or bottom 4 sheets and a loop assembly on the other of the top 2 or bottom 4 sheets. In yet a further embodiment, the securing element 10 is a zipper assembly comprising one half of the zipper assembly on one of the top 2 or bottom 4 sheets and the other half of the zipper assembly on the other of the top 2 or bottom 4 sheets. Combinations of the foregoing may also be used.

In those embodiments where the top sheet 2 is reversibly connected to the bottom sheet 4, an individual may substitute out the top 2 or bottom sheet 4 with an alternate top 2 and/or bottom 4 sheets. In such a manner, new combinations of sheets may be created to add variety to a room or a sheet may be replaced if it becomes damaged or worn. In one embodiment, the securing element in this embodiment is a zipper assembly as described above.

In any of the foregoing embodiments, the top sheet 2 and/or the bottom sheet 4 may comprise one or more pockets 20 for the placement of various items, such as cellular phones and other personal belongings. The placement of the pocket(s) 20 on the top 2 and/or bottom 4 sheets is such that the pocket(s) 20 rest against the side 104 of the mattress 100. In a particular embodiment, the bottom sheet 4 comprises the pocket(s) 20 and the top sheet 2 lacks the same. Such pocket(s) 20 may be placed on one or both sides of the top 2 and/or bottom sheets as desired. The particular dimensions of the pocket(s) 20 are not important. The material for the construction of pocket(s) 20 may be the same as the material of the top 2 or bottom 4 sheets or may be different. Any material may be used to construct the pocket(s) 20. In one embodiment, the pocket(s) 20 are manufactures from an elastic material, such as but not limited to, an elastic rubber material or an elastic mesh material, to aid in securing the objects in the pocket(s) 20.

In use, an individual applies the improved covering to the mattress 100 by placing the bottom sheet 4 on the top surface 102 of the mattress 100 and securing the edges 4*c*-4*f* along sides 108, 104 and 106, respectively. The top sheet 2 is then placed over the bottom sheet 4. Through the placement of the securing element 10, the drapes and folds of the top sheet 2 over the bottom sheet 4 are naturally formed.

When the top 2 and bottom sheets 4 are removably secured to one another, the bottom sheet 4 may be placed on the mattress 100 first and then the top sheet 2 secured to the bottom sheet 4.

In another embodiment, any of the foregoing top or bottom sheets described herein may further comprise an adjustment mechanism. In one embodiment, the adjustment mechanism adjusts the length of the top and/or bottom sheets. In another embodiment, the adjustment mechanism adjusts the width of the top and/or bottom sheets. In one embodiment, at least one of the top and bottom sheets comprises an adjustment mechanism for length. In one embodiment, at least one of the top and bottom sheets comprises an adjustment mechanism for width. In one embodiment, at least one of the top and bottom sheets comprises an adjustment mechanism for length and width. In a further embodiment, only the top sheet contains the above-described adjustment mechanisms.

A variety of adjustment mechanisms may be used. In one embodiment, the adjustment mechanism for length is a button/buttonhole assembly, a hook assembly, a hook and loop assembly, a snap assembly, a zipper assembly or a combination of the foregoing. When both the top and bottom sheet comprise an adjustment mechanism for length, the adjustment mechanism may be the same or the adjustment mechanism may be different for the top and bottom sheet. In a particular embodiment, the adjustment mechanism is a hook and loop assembly. The adjustment mechanism may be placed at any appropriate position. For sake of exemplification, the placement of the adjustment mechanism is described for placement using the top sheet. In one embodiment, the adjustment mechanism is placed on or near the bottom edge of the top sheet, such that the adjustment mechanism is hidden from view. In another embodiment, the adjustment mechanism is placed on or near the top edge of the top sheet. In such an embodiment, the adjustment element may take on a decorative function as well (for example a button/buttonhole assembly). The top sheet may have a plurality of attachment mechanisms attached to the sheet. For example, the top sheet may have one portion of the snap assembly located at or adjacent to the bottom edge and the other portion of the snap assembly located at predetermined distances from the bottom edge to allow adjustment of the length of the top sheet. In use, a user determines that the top sheet is too long for a given mattress. As a result, the top sheet may need to be shortened. The user determines the amount of the length of the top sheet that needs to be reduced and uses the adjustment mechanism to alter the length of the top sheet.

In one embodiment, the adjustment mechanism for width is an elastic material or the like. The elastic material may be in the form of a string or band. The elastic material is inserted into the sheet, such as next to the original elastic if the sheet is a bottom fitted sheet, and placed along the length of the bottom edge of the sheet. An opening is created at or adjacent to the bottom edge so that a portion of the elastic is exposed. The opening may be located at any convenient position. The portion elastic material that is exposed may be pulled taught to shorten the width of the sheet. The portion of the exposed elastic material may be further fitted with a synch to keep the elastic material in position when the elastic material is pulled taught.

What is claimed:

1. An improved covering comprising a. a top sheet, the top sheet having a top edge, a bottom edge and 2 side edges; and b. a bottom sheet, the bottom sheet having a top edge, a bottom edge and 2 side edges, the top sheet being secured to the bottom sheet by a securing element, wherein the bottom edge of the too sheet is wider than the bottom edge of the bottom sheet such that when the securing element is positioned along substantially the entire length of the bottom edge of the too sheet it also is positioned along the entire length of the bottom edge of the bottom sheet and along at least a portion of the side edges of the bottom sheet, and the securing element directly contacts the underside of a mattress to which the covering is applied so that the securing element is not visible to an observer viewing the improved covering when the improved covering is in use.

2. The improved covering of claim 1, wherein the top sheet is of such a length and width as to match the length and width of the bottom sheet when the top sheet is secured to the bottom sheet.

3. The improved covering of claim 1, wherein the securing element is stitching.

4. The improved covering of claim 1, wherein the securing element is selected from the groups consisting of: stitching, a button, a decorative element, a snap assembly, a hook and loop assembly, a zipper assembly or a combination of the foregoing.

5. The improved covering of claim 1, wherein the bottom sheet is a fitted sheet.

6. The improved covering of claim 1, wherein at least one of the top or bottom sheets further comprises a pocket.

7. The improved covering of claim 1, wherein the securing element reversibly secures the top sheet and the bottom sheet.

* * * * *